United States Patent [19]

Boat

[11] Patent Number: 4,872,279

[45] Date of Patent: Oct. 10, 1989

[54] RELOADING DEVICE FOR CARTRIDGE MAGAZINE

[75] Inventor: John L. Boat, Phoenix, Ariz.

[73] Assignee: John A. Norton, Phoenix, Ariz.

[21] Appl. No.: 242,883

[22] Filed: Sep. 12, 1988

[51] Int. Cl.[4] ..... F41C 27/00

[52] U.S. Cl. ..... 42/90

[58] Field of Search ..... 42/87, 88, 90

[56] References Cited

U.S. PATENT DOCUMENTS

| | | | |
|---|---|---|---|
| 1,245,499 | 11/1917 | Orme | 42/90 |
| 2,137,491 | 11/1938 | Huff | 42/90 |
| 2,403,012 | 7/1946 | McPheters | 86/47 |
| 2,514,277 | 7/1950 | Donnallan | 42/90 |
| 2,862,324 | 12/1958 | Ball | 42/90 |
| 2,864,193 | 12/1958 | Drew | 42/90 |
| 2,885,811 | 5/1959 | Womble, Jr. | 42/90 |
| 3,509,655 | 5/1970 | Wilhelm | 42/90 |
| 4,329,802 | 5/1982 | Coonan | 42/50 |
| 4,488,371 | 12/1984 | Boyles | 42/90 |
| 4,614,052 | 9/1986 | Brown et al. | 42/87 |
| 4,707,941 | 11/1987 | Eastman | 42/50 |

*Primary Examiner*—Charles T. Jordan

*Attorney, Agent, or Firm*—Don J. Flickinger; Jordan M. Meschkow; Lowell W. Gresham

[57] ABSTRACT

An elongate rigid member has a finger at one end which is received against the upper end of a slot extending along a cartridge magazine and a recess at the other end to cradle the retracting button of the follower. Held in compression against the force of the follower spring, the device retains the follower in the retracted position to facilitate the insertion of cartridges into the magazine.

9 Claims, 1 Drawing Sheet

RELOADING DEVICE FOR CARTRIDGE MAGAZINE

BACKGROUND OF THE INVENTION

1. Field of the Invention

This invention relates to cartridge magazines of the type normally used in connection with self-loading firearms.

More particularly, the present invention relates to devices which assist in the reloading or insertion of cartridges into a magazine.

In a further and more specific aspect, the instant invention concerns a device for retaining a follower of a magazine in a retracted position during the insertion of cartridges.

2. Prior Art

Conventionally, self-loading firearms, also commonly referred to as semi-automatic weapons, utilize a magazine for holding a supply of cartridges and for feeding the cartridges to the action. The typical magazine includes a tubular housing, usually fabricated of relatively thin metal, having an open upper end and a closed lower end. A follower, slidably disposed within the housing for reciprocal motion, is normally urged toward the open end by a compression spring. The follower includes a retracting button projecting through a slot extending along the housing.

The number of cartridges held in a magazine is subject to variance with firearm model and manufacturer, five to thirteen being typical. The several cartridges reside in stacked arrangement upon the follower. As the cartridges are taken by the action, the spring expands moving the follower ever closer to the open end of the housing. Ultimately, the follower resides adjacent the open end.

Reloading a magazine is an often repeated procedure. Commonly, the magazine is held in one hand, the thumb of which retracts and holds the follower. The cartridges are then inserted, one by one, through the open end by the other hand. Substantial pressure is required to compress the spring. Owing to the diminutiveness of the retracting button, discomfort and pain is suffered by the thumb. The trauma can be exceedingly disconcerting to any shooter, especially a marksman engaged in the precision art of competitive shooting.

The prior art has not provided satisfactory solution for the foregoing problem. It would be highly advantageous, therefore, to remedy the foregoing and other deficiencies inherent in the prior art.

Accordingly, it is an object of the present invention to provide improvements which are useful in the reloading of magazines for firearms.

Another object of the invention is the provision of improved means for retracting the follower of a cartridge magazine.

And another object of the invention is to provide improved means for retaining a follower in the retracted position.

Still another object of this invention is the provision of a reloading device which is exceptionally convenient to use.

Yet another object of the invention is to provide a reloading device which is easily engagable with a cartridge magazine.

And yet another object of the instant invention is the provision of improvements which are readily adaptable to various selected cartridge magazines.

And a further object of the invention is to provide a device which is especially compact and conveniently stowable, as in a pocket or shooting kit.

And still another object of the invention is the provision of a reloading device which is unencumbered and exceedingly durable.

Yet a further object of the immediate invention is to provide a reloading device which is relatively simple and inexpensive.

And yet a further object of the invention is the provision of a device of the foregoing character which is readily manufacturable with conventional materials and techniques.

SUMMARY OF THE INVENTION

Briefly, to achieve the desired objects of the instant invention in accordance with the preferred embodiment thereof, provided is an elongate member having first means engageable with the tubular body of a cartridge magazine and second means which are engageable with the follower thereof. Hand grip means are carried by the elongate member for manual manipulation of the device. The elongate member resides in compression against the biasing means, which normally urges the follower toward the open end of the housing, when the first means and the second means are engaged with the body and with the follower, respectively.

In accordance with the more specific embodiment of the invention, the first means and the second means reside proximate respective ends of the elongate member. The first means includes a finger which is angularly disposed to the elongate member and sized to be received within the slot extending along the housing to bear against the end thereof. The second means is shaped to receive and cradle the retracting button projecting from the receiver through the slot. The hand grip means is in the form of a projection extending laterally from the elongate member.

BRIEF DESCRIPTION OF THE DRAWINGS

The foregoing and further more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
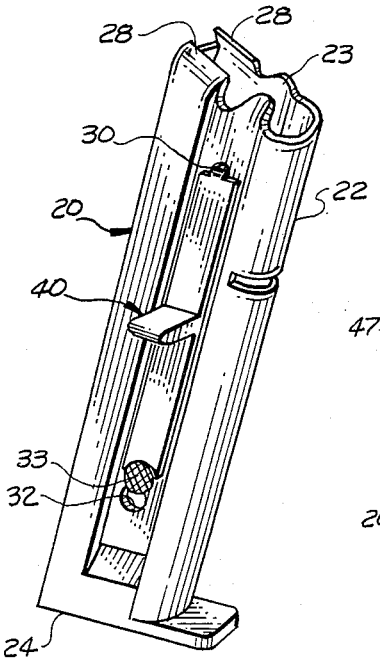
FIG. 1 is a perspective view of a conventional prior art cartridge magazine having a reloading device of the instant invention engaged therewith and retaining the follower in the retracted position.

Turning now to the drawings, in which like reference characters indicate corresponding elements throughout the several views, attention is first directed to FIG. 1 which illustrates a cartridge magazine, generally designated by the reference character 20, including elongate tubular body 22 having open upper end 23 and closed lower end 24. As seen with additional reference to FIGS. 4 and 6, follower 25 is slidably disposed within body 22 for reciprocal motion in a first direction toward open end 23 and in a second direction toward closed end 24. Compression spring 27, intermediate follower 25 and closed end 24, functions as biasing means for normally urging follower 25 toward open end 23. A plurality of cartridges are normally stacked upon follower 25 to be urged toward open end 23 to be received, one by one, by the action of the firearm. Opposed inwardly directed lips 28 retain the cartridges in opposition to spring 27 and require that the cartridges be individually removed in a forward direction. Elongate slot 29, having upper end 30 and lower end 32, extends along housing 22. Retracting button 33, engaged with follower 25, projects through slot 29.

The foregoing description is set forth for purposes of orientation and reference in connection with the ensuing detailed description of the present invention. Cartridge magazine 20 is intended to be typical of conventional prior art magazines commonly used in connection with self-loading firearms. Details not specifically illustrated and described, as well as alternate embodiments of such devices, will be readily appreciated by those skilled in the art.

Figure 2:
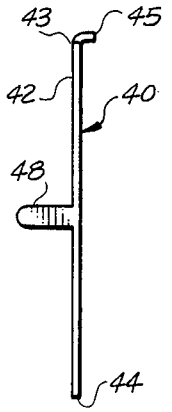
FIG. 2 is an elevation view of the right hand edge of the reloading device of FIG. 1.
Figure 3:
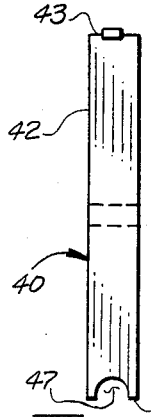
FIG. 3 is an elevation view taken from the backside of the device seen in FIG. 1.
Figure 8:
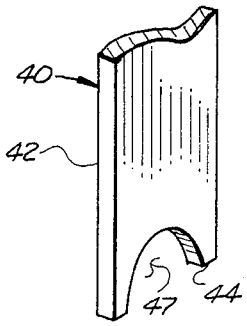
FIG. 8 is an enlarged perspective view of the lower end of the reloading device seen in FIGS. 1–7.

A reloading device, generally designated by the reference character 40 and embodying the principles of the instant invention, is seen with reference to FIGS. 1, 2 and 3. Reloading device 40 includes an elongate rigid member 42 having first end 43 and second end 44. Finger 45, projecting from upper end 43, is sized to be received within slot 29 and bear against the upper end 30. Recess 47, carried at lower end 44 as seen in greater detail with reference to FIG. 8, is shaped to receive and cradle retracting button 33. Projection 48, extending laterally from member 42 intermediate the ends thereof, functions as hand grip means for manual manipulation of the reloading device.

Figure 4:
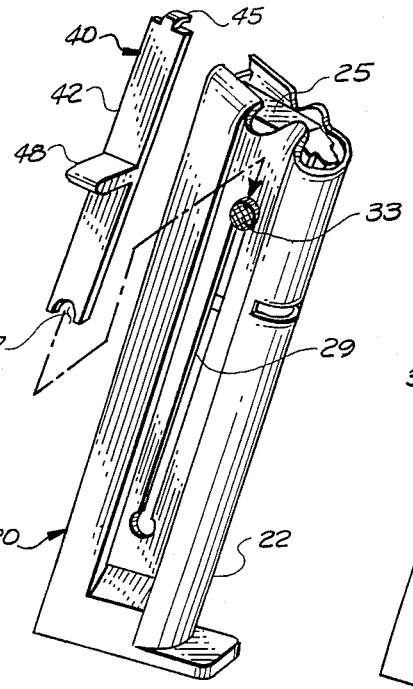
FIG. 4 is a perspective view generally similar to the view of FIG. 1 and specifically illustrating the cartridge magazine and the reloading device prior to engagement.
Figure 5:
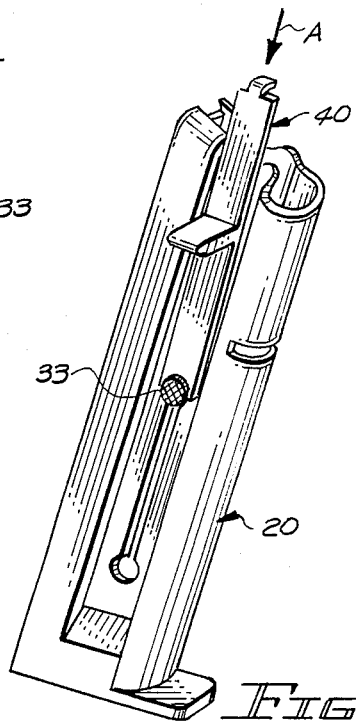
FIG. 5 is a view generally similar to the view of FIG. 4 and showing the cartridge magazine and the reloading device during an intermediate stage of engagement as the reloading device is used to retract the follower.
Figure 6:
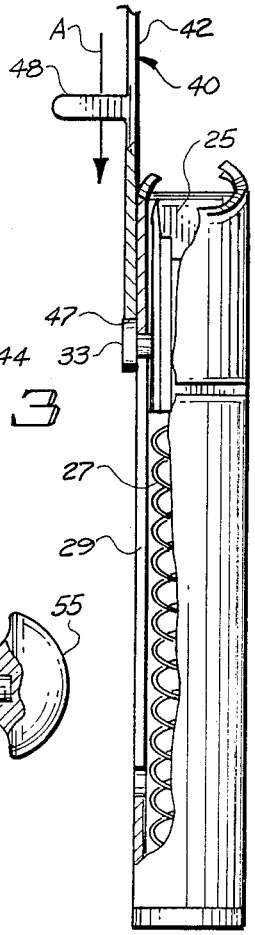
FIG. 6 is an enlarged front elevation view corresponding to the view of FIG. 5.
Figure 7:
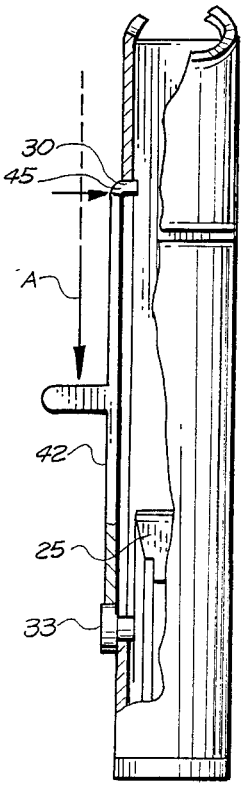
FIG. 7 is an enlarged front elevation view corresponding to the view of FIG. 1 and showing the follower in the fully retracted position and the reloading device engaged with the cartridge magazine.

Reloading device 40 is used by first placing recess 47 against retracting button 33 as seen with reference to FIGS. 4 and 6. Device 40 is then moved downwardly as indicated by the arrowed Line A in FIGS. 5 and 6. Movement in the direction of arrowed Line A is continued, compressing spring 27 and moving button 33 toward end 32 of slot 29, until finger 45 is receivable within slot 29. Ultimately, with spring 27 in the compressed position and follower 25 in the fully retracted position, member 42 resides in compression between retracting button 33, which bears against recess 47, and upper end 30 of slot 29, against which bears finger 45.

Figure 9:
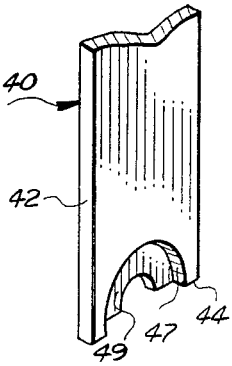
FIG. 9 is a view generally corresponding to the view of FIG. 8 and showing an alternate embodiment thereof.

In the foregoing described embodiment, recess 47 receives retracting button 33 and one side of elongate member 42 resides against body 22. Experimentation has shown this embodiment to be exceedingly effective. To further ensure an engagement between the end 44, reloading device, 40 and the follower 25, there is provided an alternate embodiment as seen with reference to FIG. 9. A relatively thin flange-like portion 49 projects inwardly from recess 47 and is received under the enlarged end of retracting button 33.

Figure 10:
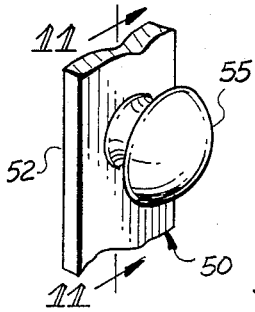
FIG. 10 is an enlarged fragmentary perspective view of an intermediate portion of the reloading device of the instant invention and specifically depicting alternate hand grip means usable in connection therewith.
Figure 11:
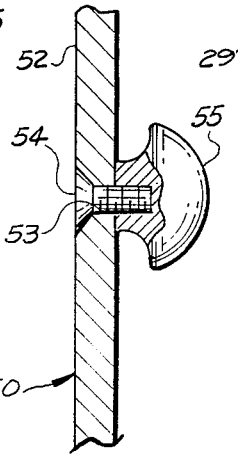
FIG. 11 is an enlarged fragmentary vertical sectional view taken along the line 11—11 of FIG. 10.

Preferably, reloading device 40 is fabricated of metal by conventional techniques such as stamping or casting. Projection 48 is an integral component. FIGS. 10 and 11 illustrate an alternate embodiment, generally designated by reference character 50 having elongate member 52. Although not specifically illustrated, the immediate embodiment is generally similar to the previously described embodiment designated by reference character 40 in that elongate member 52 terminates at one end with recess 47 and at the other end with finger 45. In contrast, however, countersunk aperture 53 resides intermediate the ends. Flat head screw 54 projects through countersunk aperture 53 and threadily engages knob 55. The function of knob 55 is equivalent to the function of projection 48.

Various modifications and variations to the embodiments herein chosen for purposes of illustration will readily occur to those skilled in the art. To the extent that such modifications and variations do not depart from the spirit of the invention, they are intended to be included within the scope thereof which is accessed only by a fair interpretation of the following claims.

Having fully described and disclosed the invention, and alternately preferred embodiments thereof, in such clear and concise terms as to enable those skilled in the art to understand and practice the same, the invention claimed is:

1. A reloading device for use in combination with a magazine, which magazine includes an elongate tubular body having an open end for receiving and discharging cartridges therethrough, an elongate slot extending longitudinally of said body, said slot having a first end proximate the open end of said body and a second end opposite said first end, a follower reciprocally disposed within said body and having a retracting button projecting through said slot, and biasing means normally urging said follower toward the open end of said body, and for retaining said follower in a retracted position to facilitate insertion of cartridges into said magazine, said reloading device comprising:

(a) an elongate member including (i) first means engageable with the first end of said slot, and (ii) second means engageable with said follower;

wherein said elongate member resides in compression against said biasing means when said first means and said second means are engaged with said end of said slot and with said follower, respectively; and (b) grip means carried by said member for manual manipulation of said device.

2. The reloading device of claim 1, wherein said first means includes a finger angularly disposed to said elongate member and sized to be received within said slot.

3. The reloading device of claim 1, wherein said second means is engagable with the retracting button of said follower.

4. The reloading device of claim 3, wherein said second means is shaped to receive and cradle said retracting button.

5. A reloading device for use in combination with a magazine, which magazine includes an elongate tubular body having an open end for receiving and discharging cartridges therethrough, an elongate slot extending longitudinally of said body, said slot having a first end proximate the open end of said body and a second end opposite said first end, a follower reciprocally disposed within said body and having a retracting button projecting through said slot, and biasing means normally urging said follower toward the open end of said body, and for retracting said follower and retaining said follower in a retracted position to facilitate insertion of cartridges into said magazine, said reloading device comprising:

(a) an elongate member including (i) first means engageable with said body, and (ii) second means engageable with said retracting button of said follower;

wherein said elongate member resides in compression against said biasing means when said first means and said second means are engaged with said body and with said retracting button of said follower, respectively; and (b) grip means carried by said member for manual manipulation of said device.

6. The reloading device of claim 5, wherein said first means is received against the first end of said slot.

7. The reloading device of claim 6, wherein said first means includes a finger angularly disposed to said elongate member and sized to be received within said slot.

8. A reloading device for use in combination with a magazine, which magazine includes an elongate tubular body having an open end for receivng and discharging cartridges therethrough, an elongate slot extending longitudinally of said body, said slot having a first end proximate the open end of said body and a second end opposite said first end, a follower reciprocally disposed within said body and having a retracting button projecting through said slot, and biasing means normally urging said follower toward the open end of said body, and for retracting said follower and retaining said follower in a retracted position to facilitate insertion of cartridges into said magazine, said reloading device comprising:

(a) an elongate member including (i) first means engageable with said body, and (ii) second means spaced apart from said first means and engageable with said follower;

wherein said elongate member resides in compression against said biasing means when said first means and said second means are engaged with said body and with said follower, respectively; and (b) hand grip means carried by said member for manual manipulation of said device, said hand grip means residing intermediate said first means and said second means.

9. A reloading device for use in combination with a magazine, which magazine includes an elongate tubular member having an open end for receiving and discharging cartridges therethrough, an elongate slot extending longitudinally of said body, said slot having a first end proximate the open end of said body and a second end opposite said first end, a follower reciprocally disposed within said body and having a retracting button projecting through said slot, and biasing means normally urging said follower toward the open end of said body, and for retracting said follower and retaining said follower in a retracted position to facilitate insertion of cartridges into said magazine, said reloading device comprising:

(a) an elongate member including (i) first means engageable with said body, and (ii) second means carried at a spaced apart location from said first means and engageable with said follower; and (b) hand grip means carried by said member for manual manipulation of said device, said hand grip means residing intermediate said first means and said second means, and including a projection extending laterally from said member.

* * * * *